US005718379A

United States Patent [19]

Cramer

[11] Patent Number: 5,718,379

[45] Date of Patent: Feb. 17, 1998

[54] LOW PROFILE FOUNTAIN

[75] Inventor: Douglas D. Cramer, Grandview, Mo.

[73] Assignee: Air-O-Lator Corporation, Kansas City, Mo.

[21] Appl. No.: 715,450

[22] Filed: Sep. 18, 1996

[51] Int. Cl.[6] ..... B05B 17/08

[52] U.S. Cl. ..... 239/17

[58] Field of Search ..... 239/16–18, 20

[56] References Cited

U.S. PATENT DOCUMENTS

| | | | |
|---|---|---|---|
| 1,462,281 | 7/1923 | Haanel | 239/20 |
| 2,922,582 | 1/1960 | Przystawik . | |
| 3,101,173 | 8/1963 | Jennings . | |
| 3,304,007 | 2/1967 | Hruby, Jr. . | |
| 3,542,292 | 11/1970 | Chase | 239/18 X |
| 3,801,010 | 4/1974 | Hruby, Jr. . | |
| 3,941,154 | 3/1976 | Bishop . | |
| 4,269,352 | 5/1981 | Przystawik . | |
| 4,819,874 | 4/1989 | Geiger . | |
| 4,948,046 | 8/1990 | Przystawik . | |

OTHER PUBLICATIONS

Air–O–Lator Corp. drawings for centrifugal pump unit on sale more than one year prior to the filing date of the present application.

Air–O–Lator Corp. brochure for Font'N–Aire® Floating Fountains showing a fountain with centrifigul pump on sale more than one year prior to the filing date of the present application.

*Primary Examiner*—Lesley D. Morris

*Attorney, Agent, or Firm*—Litman, McMahon & Brown, L.L.C.

[57] ABSTRACT

A fountain having a submersible motor and a pump secured to a frame so as to have a relatively low profile such that the entire unit is submersible in a relatively shallow pool. The pump motor is supported at a front end to the frame and along with its shaft generally extends horizontally. The pump is secured to the frame generally in front of the motor. An impeller mounted in a first pump chamber draws water into the first pump chamber through an intake opening on a rear wall of the pump housing. The water is directed out a side of the first pump chamber, through a first pump chamber discharge passageway and back through a pump return passageway and into a second pump chamber. The water is then directed out of the pump housing through a discharge opening on a front wall thereof which is aligned with the intake opening. The water is then directed through a piping assembly which is secured to the front wall of the pump housing. At least one vertical branch extends from a horizontally extending main branch of the piping assembly. Each vertical branch includes a nozzle secured at an upper end thereof.

12 Claims, 1 Drawing Sheet

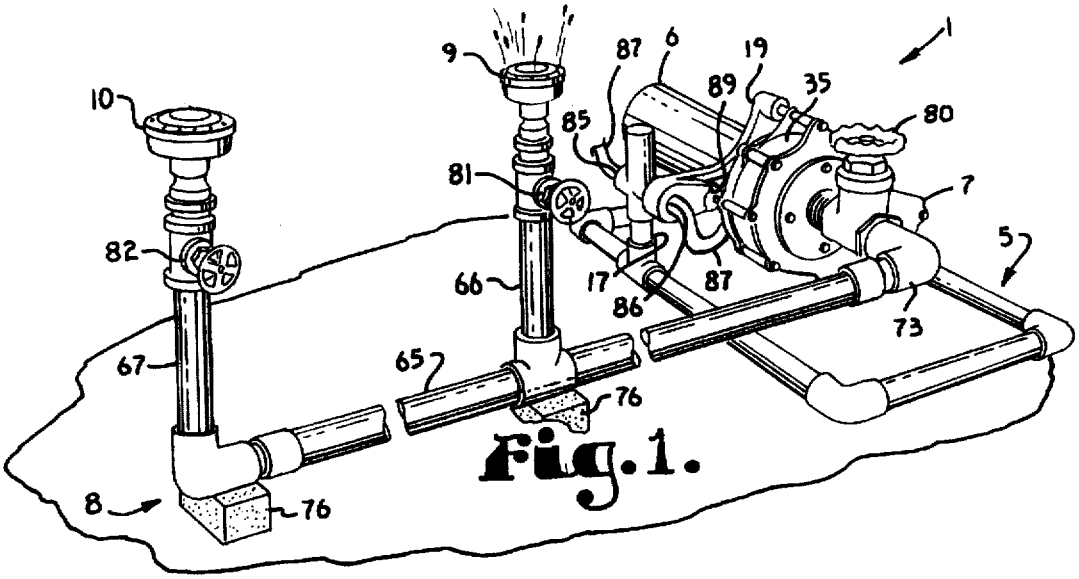
Fig. 1.
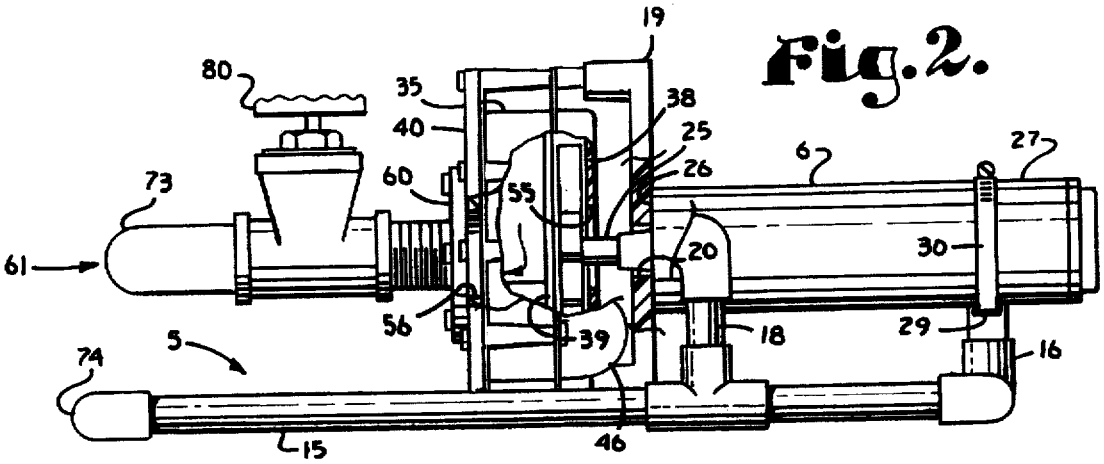
Fig. 2.
Fig. 3.
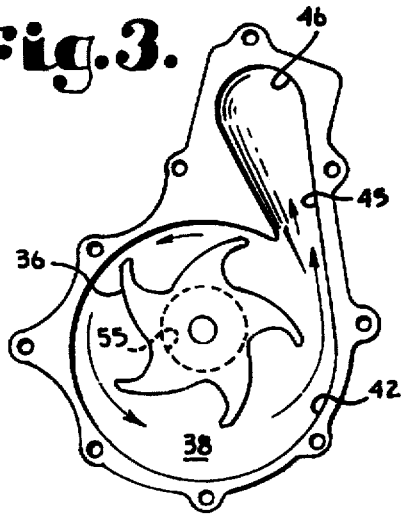
Fig. 4.
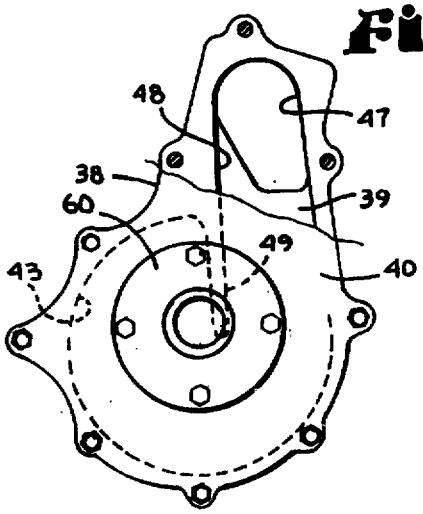

LOW PROFILE FOUNTAIN

BACKGROUND OF THE INVENTION

The present invention relates to decorative pool fountains and in particular such fountains utilizing submersible motors and centrifugal pumps.

Relatively low cost fountains have become increasingly popular for applications in decorative pools. However, many decorative pools are relatively shallow and will not accommodate commercially available fountains which provide a relatively substantial and appealing spray pattern or which are powerful enough to supply water under sufficient pressure for multiple fountain heads.

SUMMARY OF THE INVENTION

The present invention comprises a fountain having a submersible motor and a pump secured to a frame such that the entire unit is submersible in a relatively shallow pool. The relatively low profile of the pump is obtained through the configuration of the pump and the arrangement of the components on the frame.

The pump motor is supported at a front end to the frame and along with its shaft generally extends horizontally. The pump is secured to the frame generally in front of the motor and includes a pump housing having a front wall, a rear wall and a center wall defining first and second pump chambers therebetween.

The first pump chamber is formed between the rear and center walls of the pump housing. The shaft extends through a vertically extending inlet opening in the rear wall. An impeller is mounted on the shaft in the first pump chamber for drawing water into the chamber and out a first pump chamber discharge passageway which communicates with the second pump chamber through a pump return passageway. The second pump chamber is formed between the front and center walls and a discharge opening extends generally vertically through the front wall. The discharge opening is axially aligned with the inlet opening. The first pump chamber discharge passageway and the pump return passageway preferably extend to the side of the pump housing to provide a lower profile.

A piping assembly is secured to the front wall of the pump housing over and in communication with the discharge opening therein. At least one vertical branch extends from a horizontally extending main branch of the piping assembly. Each vertical branch includes a nozzle secured at an upper end thereof. A front edge of the base preferably extends forward of a forwardmost portion of the piping assembly to prevent the fountain from tipping forward in response to the torsional forces exerted on the piping assembly. A rear portion of the motor is supported on a motor support mounted on the frame.

OBJECTS AND ADVANTAGES OF THE INVENTION

Therefore it is an object of the present invention to provide a submersible fountain having a relatively low profile; to provide such a fountain which is submersible in relatively shallow pools; to provide such a fountain in which a motor and pump thereof may be submersed in a relatively shallow sump; to provide such a fountain having sufficient power to provide water under adequate pressure to operate multiple fountain nozzles; to provide such a fountain which is relatively lightweight and easy to install; and to provide such a fountain which is relatively inexpensive.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 1 is a perspective view of a low profile fountain of the present invention.

FIG. 2 is an enlarged right side elevational view of the low profile fountain of the present invention with portions broken away to show detail thereof.

FIG. 3 is a fragmentary cross-sectional view taken generally along line 3—3 of FIG. 2 showing the pump housing which has been rotated ninety degrees.

FIG. 4 is a fragmentary cross-sectional view taken generally along line 4—4 of FIG. 2 with portions broken away and showing the pump housing which has been rotated ninety degrees.

DETAILED DESCRIPTION OF THE INVENTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in more detail, the reference numeral 1 refers to a low profile fountain of the present invention. The fountain 1 includes a frame 5, a submersible electric motor 6, a pump 7, a discharge piping assembly 8 and first and second nozzles 9 and 10. The electric motor 6 is of the type generally having an elongate cylindrical housing.

The frame 5 includes a base 15, a rear motor support 16 and left and right side support arms 17 and 18 and a motor mounting bracket 19. The motor mounting bracket 19 extends between and is supported by the left and right side support arms 17 and 18. A bore 20 extends through the motor mounting bracket 19 generally centrally thereof. The base 15, the rear motor support 16 and the left and right side support arms 17 and 18 may be constructed of plastic tubing as generally shown in FIGS. 1 and 2 of from molded plastic. Plastic is a preferred material of construction for the frame because it is lightweight and will not corrode.

The motor 6 is a water-cooled, water-lubricated submersible motor. The motor 6 includes a shaft 25 extending from a front end 26 thereof. The front end 26 of the motor 6 is bolted or otherwise mounted to the motor mounting bracket 19 such that the shaft extends horizontally through the bore 20 therein. A rear portion or end 27 of the motor 6 is supported on the rear motor support 16 which incorporates a curved upper surface, generally conforming to the shape of the outer surface of the motor 6. The rear motor support 16 includes an aperture or slot 29 extending therethrough through which a strap 30 may be threaded for strapping the rear end 27 of the motor 6 to the rear motor support 16.

The pump 7 includes a pump housing 35 and an impeller 36. The pump housing 35 generally includes a rear wall 38, a center wall 39 and a front wall 40. Each of the walls 38, 39 and 40 are generally vertically aligned in parallel and spaced apart relation. A circular pump chamber 42 is formed by the housing 35 between the rear and center walls 38 and 39. A circular discharge chamber 43 is formed by the housing 35 between the center and front walls 39 and 40.

A pump chamber discharge passageway 45 is formed in the pump housing 35 and extends tangentially from the pump chamber 42 to a rounded end portion or elbow 46 which is positioned adjacent a connecting opening 47 extending through the center wall 39 and into a pump return passageway 48 which generally extends back along the path of the pump chamber discharge passageway 45 on an opposite side of the center wall 39. The pump return passageway 48 opens into the pump discharge chamber 43 which is generally aligned with the pump chamber 42 on an opposite side of the center wall 39. A flow deflecting wall 49 generally comprising an extension of the portion of the pump housing 35 defining the pump return passageway 48 extends partially across the pump discharge chamber 43.

A circular inlet opening 55 is formed in the rear wall 38 of the pump housing 35 and a circular discharge opening 56 is formed in the front wall 40. The pump housing 35 is bolted or otherwise mounted to the motor mounting bracket 19 such that the shaft 25 extends centrally through the inlet opening 55 in the rear wall 38 of the housing 35. The impeller 36 is mounted to the shaft 25 within the pump chamber 42. The discharge opening 56 and the inlet opening 55 are generally aligned along the axis of the shaft 25.

Rotation of the impeller 36 by the shaft 25 and electric motor 6, pulls water into the pump chamber 42 through the inlet opening 55. The water is pushed by the impeller 36 through the pump chamber discharge passageway 45, the connecting opening 47, the pump return passageway 48 and into the discharge chamber 43. The water rotates around the discharge chamber 43 and into the flow deflecting wall 49 which deflects or directs the water out the discharge opening 56 in the front wall 40 of the pump housing 35.

The pump housing 35 is mounted to the motor mounting bracket 19 such that the pump chamber discharge passageway 45 and the pump return passageway 48 generally extend horizontally and tangentially relative to the pump chamber 42 and the discharge chamber 43 respectively and along the lower periphery thereof.

An annular flange plate 60 is bolted or otherwise mounted to the front wall 40 across the discharge opening 56. The piping assembly 8 is connected to the flange plate 60 and in flow communication with the pump 7 through the discharge opening 56 in the pump housing 35. The piping assembly 8 includes a main branch 65 extending horizontally from the pump 7 and a first vertical branch 66 and a second vertical branch 67 extending vertically from and in flow communication with the main branch 65. The first and second spray nozzles or fountain nozzles 9 and 10 are mounted on the end of each vertical branch 66 and 67 respectively.

It is foreseen that a wide variety of nozzle types could be utilized with the low profile fountain disclosed to achieve different visual or aeration related characteristics. The vertical branches 66 and 67 are sized such that the fountain nozzles 9 and 10 are positioned at the surface of the water or as otherwise desired with the particular nozzle utilized. Further, it is foreseen that the system could be modified for use with a single or multiple nozzles.

In a system using a single nozzle, it is likely that a vertical branch would extend off of the main branch 65 in closely spaced relation to the front of the pump 7, such as where elbow 73 is located in FIGS. 1 and 2. To prevent the fountain 1 from tipping forward due to the downward forces exerted at the elbow 73 in such a configuration, a front edge 74 of the base portion 15 extends beyond or forward of the elbow 73. Similarly, blocks 76 may be positioned under the vertical branches 66 and 67 of the piping assembly 8 to support the piping assembly 8 against the torsional forces imparted thereon through the flow of water through the vertical branches 66 and 67.

A first shut off valve 80 is mounted on the main branch 65 upstream from the first and second vertical branches 66 and 67. Second and third shut off valves 81 and 82 are mounted on the first and second vertical branches respectively upstream of the respective nozzles 9 and 10.

A first cable hole 85 extends horizontally through the left side support arm 17. A second cable hole 86 extends horizontally through the motor mounting bracket 19 and is aligned with the first cable hole 85. A waterproof and flexible conduit 87, with electrical wiring (not shown) positioned therein, is run through the first and second cable holes 85 and 86. The flexible conduit 87 is extended through an opening 89 in the motor mounting bracket 19, extending toward the left side support arm 17, and the wiring is connected to the motor 6 at a front end 26 thereof via a waterproof connection. The conduit 87 and wiring extend out of the pool in which the fountain 1 is placed and are connected to a control panel not shown. The conduit 87 is extended through the holes 85 and 86 in the support arm 17 and the motor mounting bracket 19 to keep the excess conduit 87 away from the shaft 25.

A filter or screen, not shown, may be placed across the inlet opening 55 to screen out of the water material which might plug the nozzles 9 and 10.

It is to be understood that while certain forms of the present invention have been illustrated and described herein, it is not to be limited to the specific forms or arrangement of parts described and shown.

What is claimed and desired to be secured by Letters Patent is as follows:

1. A fountain comprising:

a. a frame;

b. a submersible motor mounted to said frame and having a shaft extending therefrom in horizontal alignment;

c. a centrifugal pump mounted to said frame and including a pump housing and an impeller; said pump housing including an inlet opening, a first chamber, a first chamber discharge passageway, a pump return passageway, a second chamber in communication with said first chamber through said first chamber discharge passageway and said pump return passageway, and a discharge opening; said inlet opening extending vertically through a rear wall of said pump housing and into said first chamber; said first chamber discharge passageway extending generally horizontally and tangentially away from said first chamber; said pump return passageway extending generally horizontally and tangentially toward said second chamber on an opposite side of a center wall extending between said first and second chambers; said discharge opening extending vertically through a front wall of said pump housing and in horizontal alignment with said inlet opening; said impeller mounted on said shaft in said first chamber; and d. a piping assembly secured to said front wall of said pump housing and having at least one nozzle secured to an opposite end thereof.

2. The fountain as in claim 1 wherein:

a. said frame includes a base having a rear motor support member secured thereto and supporting a rear end of said motor thereon.

3. The fountain as in claim 2 wherein:

a. said rear motor support member includes a strap secured thereto for securing a rear end of said motor to said rear motor support member.

4. The fountain as in claim 3 wherein:

a. said rear motor support member includes a slot extending therethrough through which said strap may be extended for securing said strap to said rear motor support member.

5. The fountain as in claim 1 wherein:

a. said piping assembly includes a plurality of vertically extending branches each having a nozzle secured thereto.

6. The fountain as in claim 1 wherein:

a. said frame includes a base having a front edge positioned forward of a portion of said piping assembly extending directly in front of said pump.

7. The fountain as in claim 1 wherein:

a. said frame includes a base portion, a pair of support arms extending vertically from said base and a motor mounting bracket secured to said support arms to which said motor and said pump are secured; and b. said fountain further includes a waterproof conduit with wiring extending therethrough, extending through a hole in one of said support arms and secured to a front end of said motor.

8. A fountain comprising:

a. a frame including a base portion and first and second support arms having a motor mounting bracket secured thereto;

b. a submersible motor mounted to said motor mounting bracket and having a shaft extending therefrom in horizontal alignment;

c. a centrifugal pump mounted to said motor mounting bracket and including a pump housing and an impeller; said pump housing including an inlet opening, a first chamber, a second chamber in communication with said first chamber; said inlet opening extending vertically through a rear wall of said pump housing and into said first chamber; said discharge opening extending vertically through a front wall of said pump housing and in horizontal alignment with said inlet opening; said impeller mounted on said shaft in said first chamber; and d. a piping assembly secured to said front wall of said pump housing and having at least one nozzle secured to an opposite end thereof; a front edge of said base portion extending forward of a forwardmost portion of said piping assembly extending directly in front of said pump.

9. The fountain as in claim 8 wherein:

a. said base portion includes a rear motor support member secured thereto and supporting a rear end of said motor thereon.

10. The fountain as in claim 9 wherein:

a. said rear motor support member includes a strap secured thereto for securing a rear end of said motor to said rear motor support member.

11. The fountain as in claim 10 wherein:

a. said rear motor support member includes a slot extending therethrough through which said strap may be extended for securing said strap to said rear motor support member.

12. The fountain as in claim 8 wherein:

a. said piping assembly includes a plurality of vertically extending branches each having a nozzle secured thereto.

* * * * *